US007740239B2

(12) United States Patent
Tsuchihashi

(10) Patent No.: US 7,740,239 B2
(45) Date of Patent: Jun. 22, 2010

(54) SHEET PROCESSING APPARATUS

(75) Inventor: Hiroyuki Tsuchihashi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 524 days.

(21) Appl. No.: 11/615,342

(22) Filed: Dec. 22, 2006

(65) Prior Publication Data

US 2008/0150212 A1 Jun. 26, 2008

(51) Int. Cl.
*B65H 37/04* (2006.01)

(52) U.S. Cl. ..... 270/58.07; 270/58.01; 270/58.08; 270/58.11; 270/58.12; 270/58.17; 270/58.27

(58) Field of Classification Search ..... 270/58.01, 270/58.07, 58.08, 58.09, 58.11, 58.12, 58.17, 270/58.27

See application file for complete search history.

(56) References Cited

U.S. PATENT DOCUMENTS 6,551,052 B2 * 4/2003 Bakoledis ..... 414/790.3
2005/0201790 A1 * 9/2005 Inoue ..... 399/390
2006/0066034 A1 * 3/2006 Terao et al. ..... 270/58.11

FOREIGN PATENT DOCUMENTS

JP 10-250911 9/1998
JP 2001089009 A * 4/2001
JP 2004-99200 4/2004

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus of the invention includes a standby tray on which a sheet discharged from an image forming apparatus is placed, a processing tray on which the sheet dropped from the standby tray is received and placed, and a post-processing mechanism to perform a post-processing on the sheet placed on the processing tray, and further, an electricity removing brush is attached integrally to a rotation shaft disposed in a direction orthogonal to a transport direction of the sheet at a height position between the standby tray and the processing tray. The electricity removing brush comes in contact with a lowermost surface of the sheet placed on the standby tray or an uppermost surface of the sheet placed on the processing tray by rotation of the rotation shaft, and removes the electricity of the sheet.

12 Claims, 10 Drawing Sheets

SHEET PROCESSING APPARATUS

BACKGROUND OF THE INVENTION

1. Field of the Invention

The present invention relates to a sheet processing apparatus for performing post-processing of a sheet discharged from an image forming apparatus such as a copying machine, a printer or a compound machine.

2. Description of the Related Art

In recent years, some image forming apparatuses are provided with a sheet post-processing apparatus adjacently to a paper discharge unit of an image forming apparatus main body in order to perform post-processing such as sorting of sheets after image formation or stapling of sheets.

In the case where the post-processing such as the stapling is performed on the sheet transported from the image forming apparatus, the sheet is often charged with static electricity. When the sheet is charged, a jam occurs or a trouble occurs in the post-processing. Besides, a discharge operation after the post-processing is not performed well, and defective discharge is liable to be caused. Thus, some post-processing apparatuses are provided with an electricity removing member.

JP-A-2004-99200 discloses a sheet post-processing apparatus for performing a binding processing of sheets. In this sheet post-processing apparatus, after plural sheets are bound, they are discharged by a paper discharge roller, and an electricity removing brush is provided in a sheet transport path.

JP-A-10-250911 discloses a sheet post-processing apparatus for performing post-processing such as stapling. In this example, there is included a guide member to guide a sheet to a processing tray for the post-processing, and an electricity removing member is provided in this guide member.

However, in the above examples, since the system is such that the electricity removing member comes in contact with only one surface of the transported sheet, when plural sheets overlap each other, a satisfactory electricity removing effect can not be obtained.

The invention provides a sheet processing apparatus in which the electrostatic charging of a sheet as stated above is reduced.

DETAILED DESCRIPTION OF THE INVENTION

Throughout this description, the embodiments and examples shown should be considered as exemplars, rather than limitations on the apparatus of the present invention.

Hereinafter, embodiments of the invention will be described in detail with reference to the drawings. In the respective drawings, same portions are denoted by same symbols and will be described.

Figure 1:
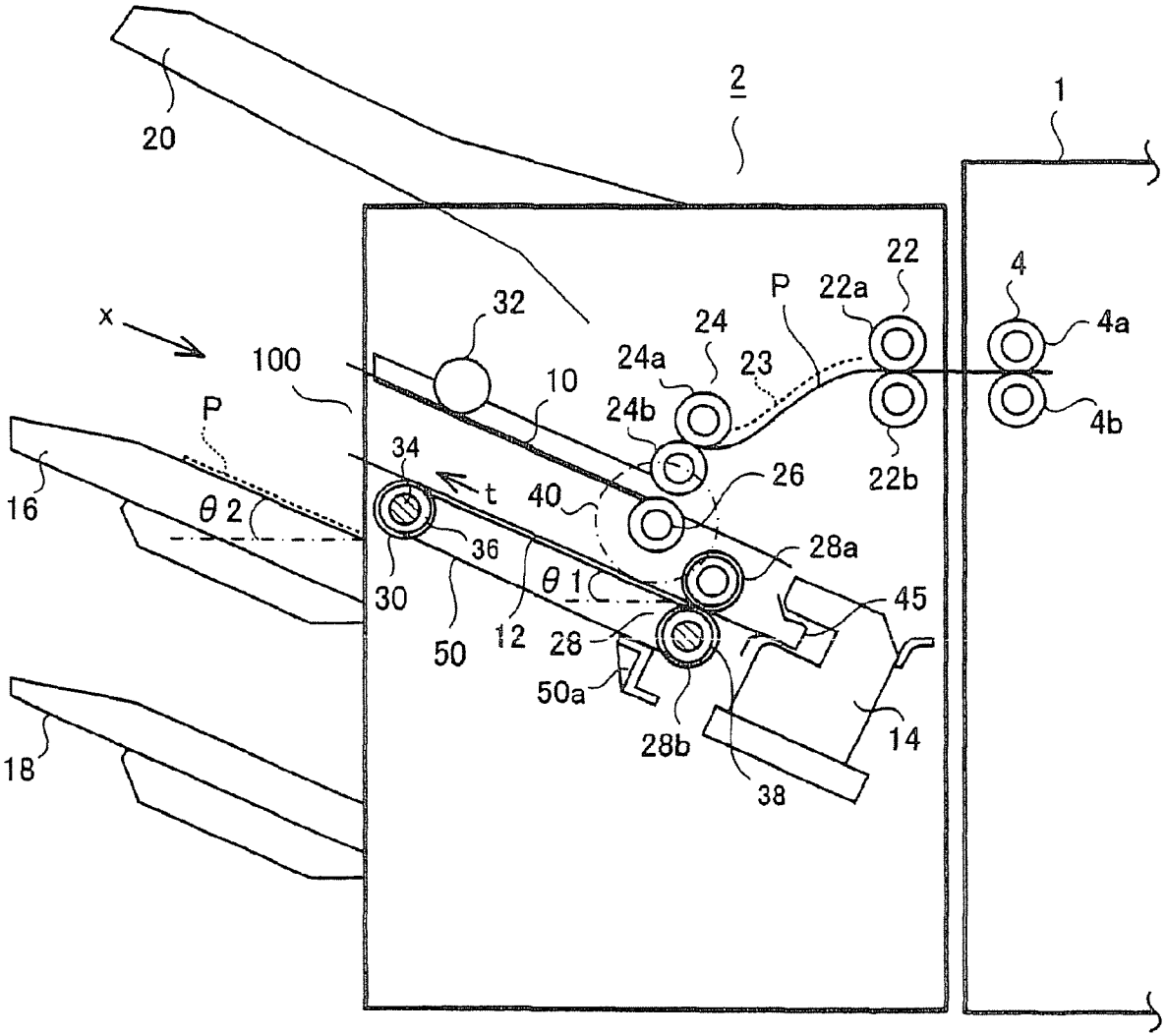
FIG. 1 is a schematic structural view showing a sheet processing apparatus according to an embodiment of the invention.

FIG. 1 is a schematic structural view showing a sheet post-processing apparatus 2 disposed adjacently to an image forming apparatus 1 such as a copying machine. A sheet P on which an image is formed by the image forming apparatus 1 is discharged from a paper discharge roller 4, and is transported to the sheet post-processing apparatus 2. The paper discharge roller 4 includes an upper roller 4*a* and a lower roller 4*b*.

The sheet post-processing apparatus 2 includes a standby tray 10, a processing tray 12, a stapler 14, a first paper discharge tray 16, a second paper discharge tray 18, and a fixed tray 20.

The sheet P discharged by the paper discharge roller 4 of the image forming apparatus 1 is received by an entrance roller 22 provided in the vicinity of an carry-in entrance of the sheet post-processing apparatus 2. The entrance roller 22 includes an upper roller 22*a* and a lower roller 22*b*, and is driven by a motor (not shown).

A paper feed roller 24 is provided at the downstream side of the entrance roller 22, and the sheet P received by the entrance roller 22 is sent to the standby tray 10 through the paper feed roller 24. A paper path 23 for guiding the sheet P to the paper feed roller 24 is provided between the entrance roller 22 and the standby tray 10. The paper feed roller 24 includes an upper roller 24*a* and a lower roller 24*b*.

The standby tray 10 has such a structure that the sheet P is placed thereon and opening is possible. The processing tray 12 on which the sheet P dropped from the standby tray 10 is placed is disposed below the standby tray 10. When a specified number of sheets P are accumulated on the standby tray 10, the standby tray 10 is opened, and the sheets P are dropped by their own weight to the processing tray 12. The processing tray 12 aligns and supports the sheets P while the sheets P are stapled by the stapler 14 as a post-processing mechanism.

The sheet dropped on the processing tray 12 is guided to the stapler 14 by a roller 28 and is subjected to stapling processing. The roller 28 includes an upper roller 28*a* and a lower roller 28*b*. In the case where the staple processing is performed, the plural sheets P dropped on the processing tray 12 from the standby tray 10 are aligned in the longitudinal direction as the transport direction and are aligned in the lateral direction orthogonal to the transport direction, and the staple processing is performed.

Besides, a rotatable paddle 40 is disposed at a position where the rear end of the sheet P is dropped when the sheet P is dropped onto the processing tray 12.

Figure 3:
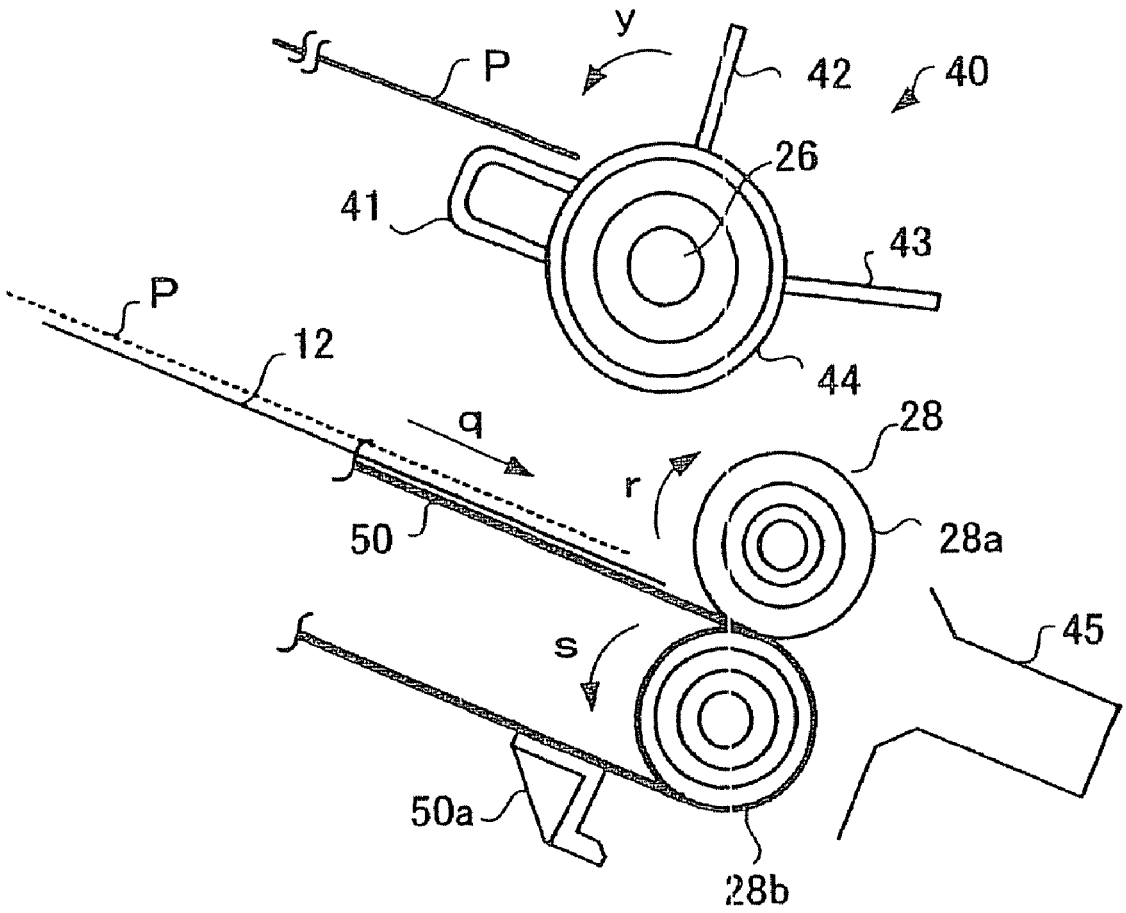
FIG. 3 is an explanatory view showing a paddle of the sheet processing apparatus of the invention.

The paddle 40 is attached to a rotation shaft 26, flicks the sheet P dropping from the standby tray 10 onto the processing tray 12, and sends the sheet P in the direction toward the stapler 14. The details of the paddle 40 are shown in FIG. 3 and will be described later.

A stopper 45 to regulate the rear end position of the sheet P is provided at the end of the processing tray 12 on the stapler 14 side. Besides, there is provided a transport belt 50 to transport the sheet P, which has been subjected to the sort processing or staple processing, to the first paper discharge tray 16 or the second paper discharge tray 18.

The transport belt 50 is stretched between pulleys 36 and 38, and a hook member 50*a* to catch and send the rear end of the sheet P is attached to the transport belt 50. The lower roller 28*b* of the roller 28 is disposed coaxially with the pulley 38, and the roller 28 rotates in opposite directions between at the time when the aligned sheet is guided in the direction toward the stapler 14 and at the time when the sheet P subjected to the staple processing is discharged.

The pulley 36 is attached to a shaft 34, and plural discharge rollers 30 are rotatably attached to this shaft 34. The discharge rollers 30 will be described in FIG. 2.

The sheet P transported by the transport belt 50 is discharged to the first paper discharge tray 16 or the second paper discharge tray 18, and the first paper discharge tray 16 and the second paper discharge tray 18 are moved up and down by a driving unit (not shown) and receive the sheet P.

There is also a case where the sheet P placed on the standby tray 10 is discharged to the first paper discharge tray 16 or the second paper discharge tray 18 without being subjected to the staple processing. In this case, the sheet P is not dropped to the processing tray 12 but is discharged by a roller 32.

The standby tray 10 is disposed to have an inclination angle θ1 so that the sheet P is supported in such a state where the front end of the sheet P is higher than the rear end, and the paper discharge trays 16 and 18 are also disposed to have an inclination angle θ2 so that the sheet P is supported in such a state that the front end of the sheet P is higher than the rear end.

The sheet P not requiring the post-processing can also be discharged to the fixed tray 20. Although a transport path is provided in order to guide the sheet P to the fixed tray 20, its illustration is omitted.

Figure 2:
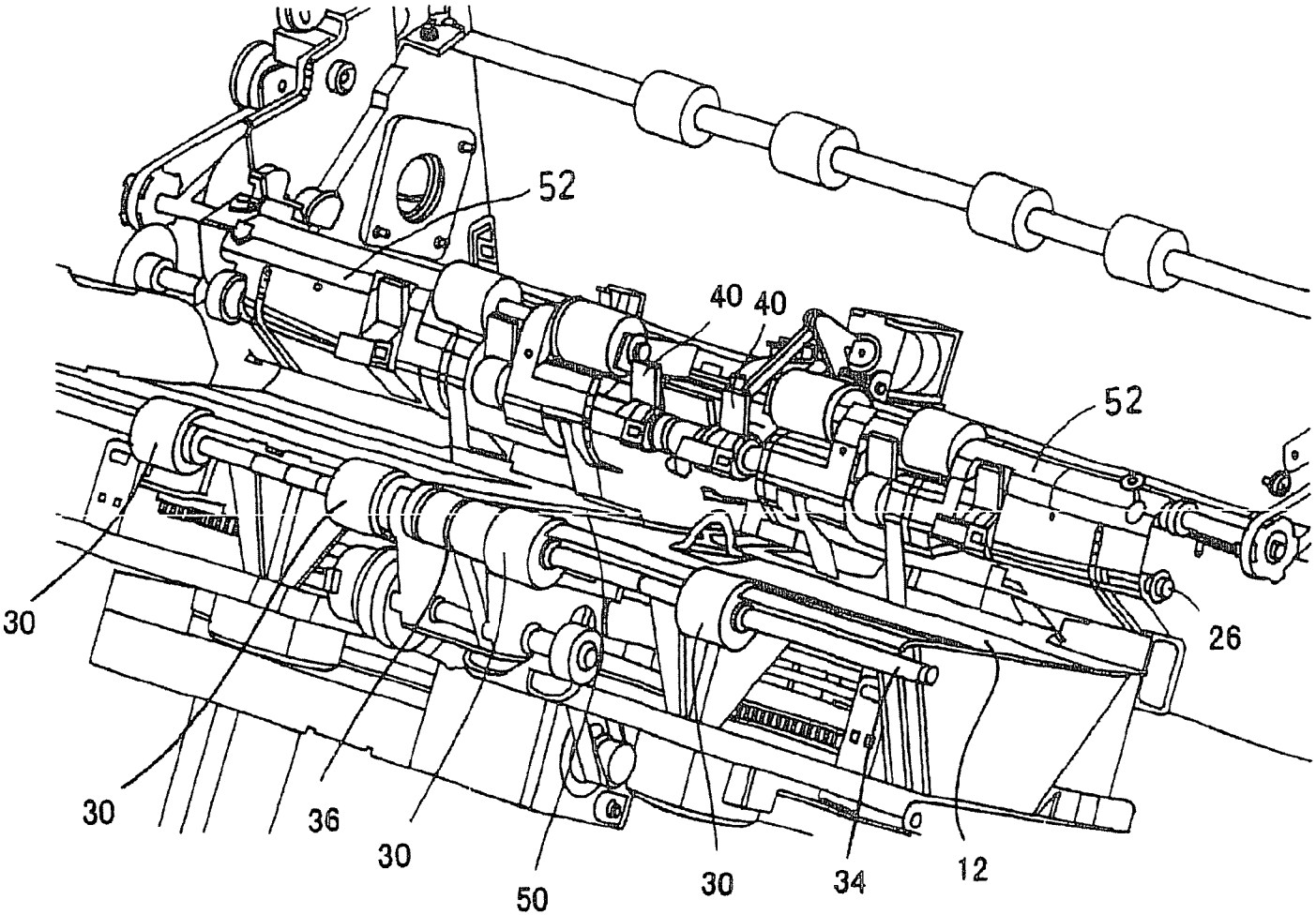
FIG. 2 is a perspective view showing a main part of the sheet processing apparatus of the invention.

FIG. 2 is a perspective view of the main part of the sheet post-processing apparatus 2 and is a view seen in the direction of an arrow x of FIG. 1.

In FIG. 2, the shaft 34 is disposed to be orthogonal to the transport direction of the sheet P, the pulley 36 is attached to an intermediate part of the shaft 34, and the belt 50 is stretched over this pulley 36. The discharge rollers 30 are attached to the center part and both sides of the shaft 34, and are rotated by the rotation of the belt 50.

FIG. 3 shows a structure of the paddle 40. In the paddle 40, an attachment member 44 is attached to the rotation shaft 26, and the attachment member 44 is radially provided with a receiving part 41 to receive the rear end of the sheet P dropping from the standby tray 10, a flicking part 42 to flick the sheet P onto the processing tray 12, and a sending part 43 to send the sheet P on the processing tray 12 in the direction toward the stapler 14.

In the case where the sheet P on the processing tray 12 is sent in the direction (arrow q) toward the stapler 14, the upper roller 28*a* of the roller 28 rotates in a counterclockwise direction, and the lower roller 28*b* rotates in a clockwise direction, whereas in the case where the sheet P on the processing tray 12 is discharged, the upper roller 28*a* rotates in an arrow r direction, and the lower roller 28*b* rotates in an arrow s direction.

Figure 4:
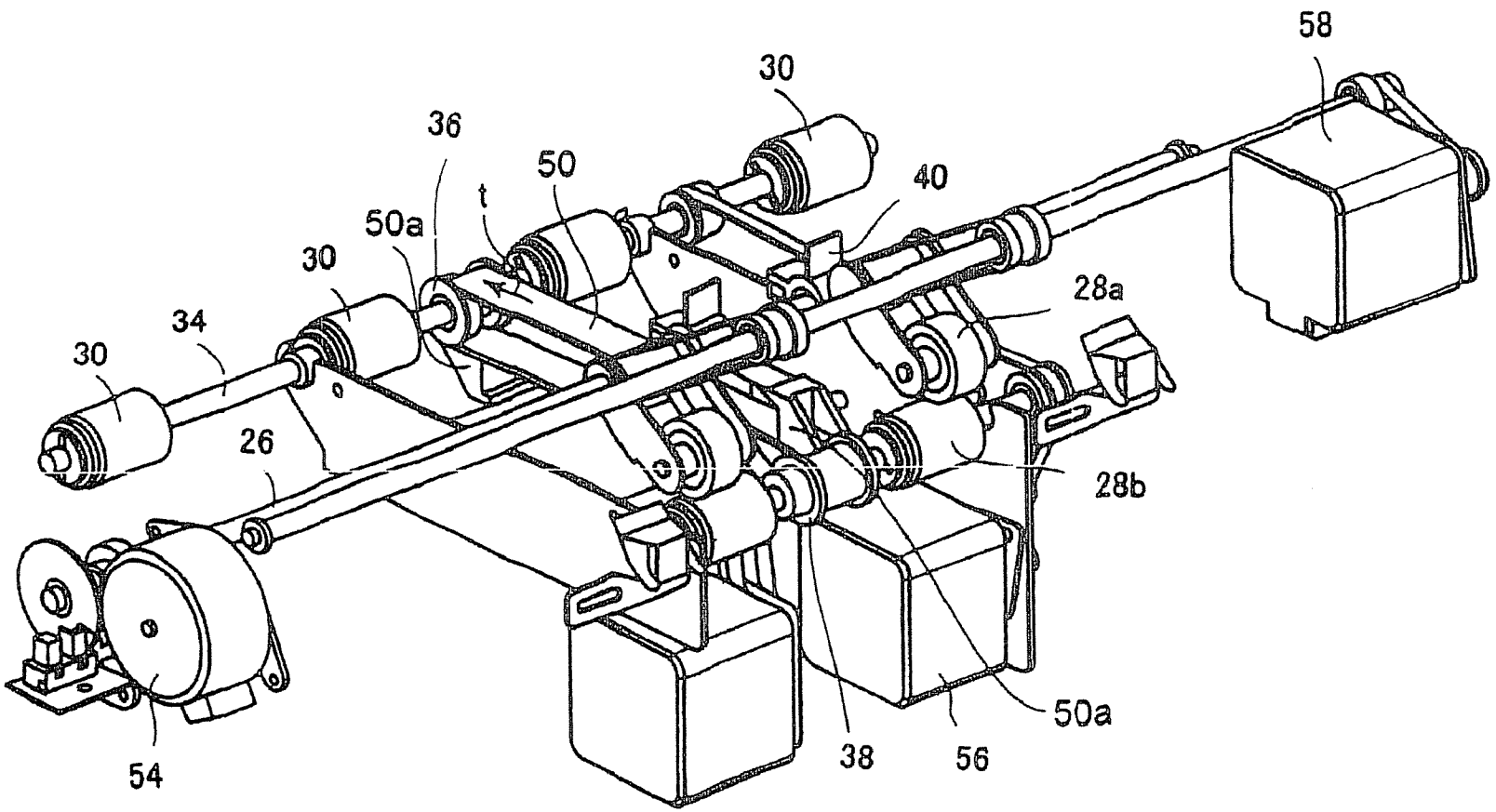
FIG. 4 is a schematic perspective view showing a longitudinal alignment roller of the sheet processing apparatus of the invention.

The rotation shaft 26 is rotation-driven by a motor 54 (see FIG. 4). Alternatively, the rotation force of the motor may be transmitted to the rotation shaft 26 through a gear mechanism. The flicking part 42 and the sending part 43 of the paddle 40 are made of rubber material and have elasticity.

As is understood from FIG. 2, a plurality of the paddles 40 are attached to the rotation shaft 26. Further, a guide member 52 is provided in order to guide the sheet to the processing tray 12. The guide member 52 becomes a guide when the rear end of the transported sheet P is drawn to the stapler 14 side.

FIG. 4 is a schematic perspective view showing a structure of the roller 28 for longitudinal alignment of the sheet P and the transport belt 50. As shown in FIG. 4, the transport belt 50 is stretched between the pulleys 36 and 38, is rotation-driven by a motor 56, and is circularly rotation-moved between the stapler 14 and a sheet discharge port 100 (FIG. 1) along the discharge direction of the sheet.

When the sheet is transported in the direction toward the paper discharge trays 16 and 18, the transport belt 50 moves in an arrow t direction, and the upper roller 28*a* and the lower roller 28*b* for longitudinal alignment are rotated in the arrow r direction and the arrow s direction of FIG. 3. The upper roller 28*a* for longitudinal alignment is rotation-driven by a motor 58, and the lower roller 28*b* is rotation-driven by the motor 56 to drive the transport belt 50.

Figure 5:
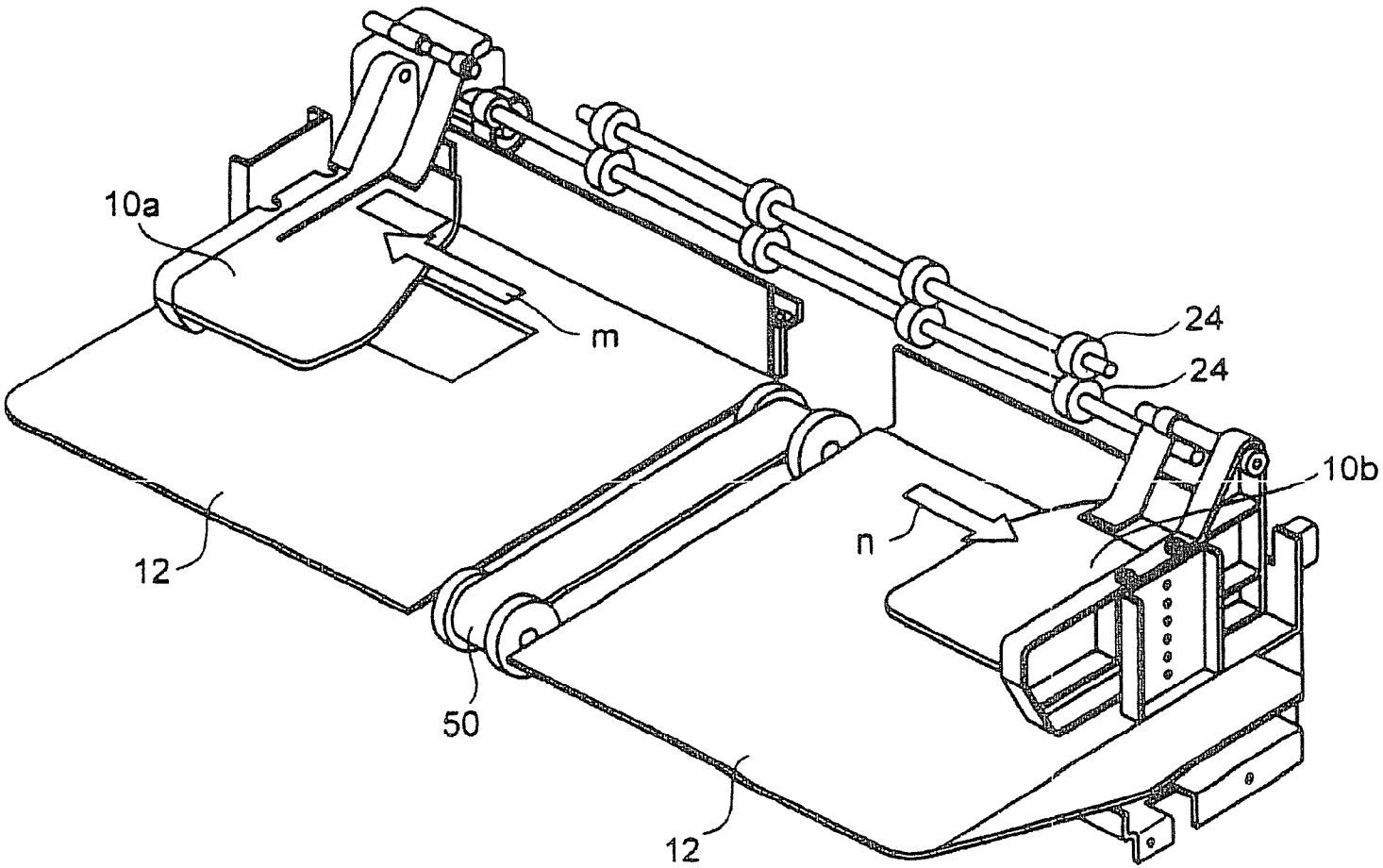
FIG. 5 is a schematic perspective view showing a standby tray and a processing tray of the sheet processing apparatus of the invention.
Figure 6:
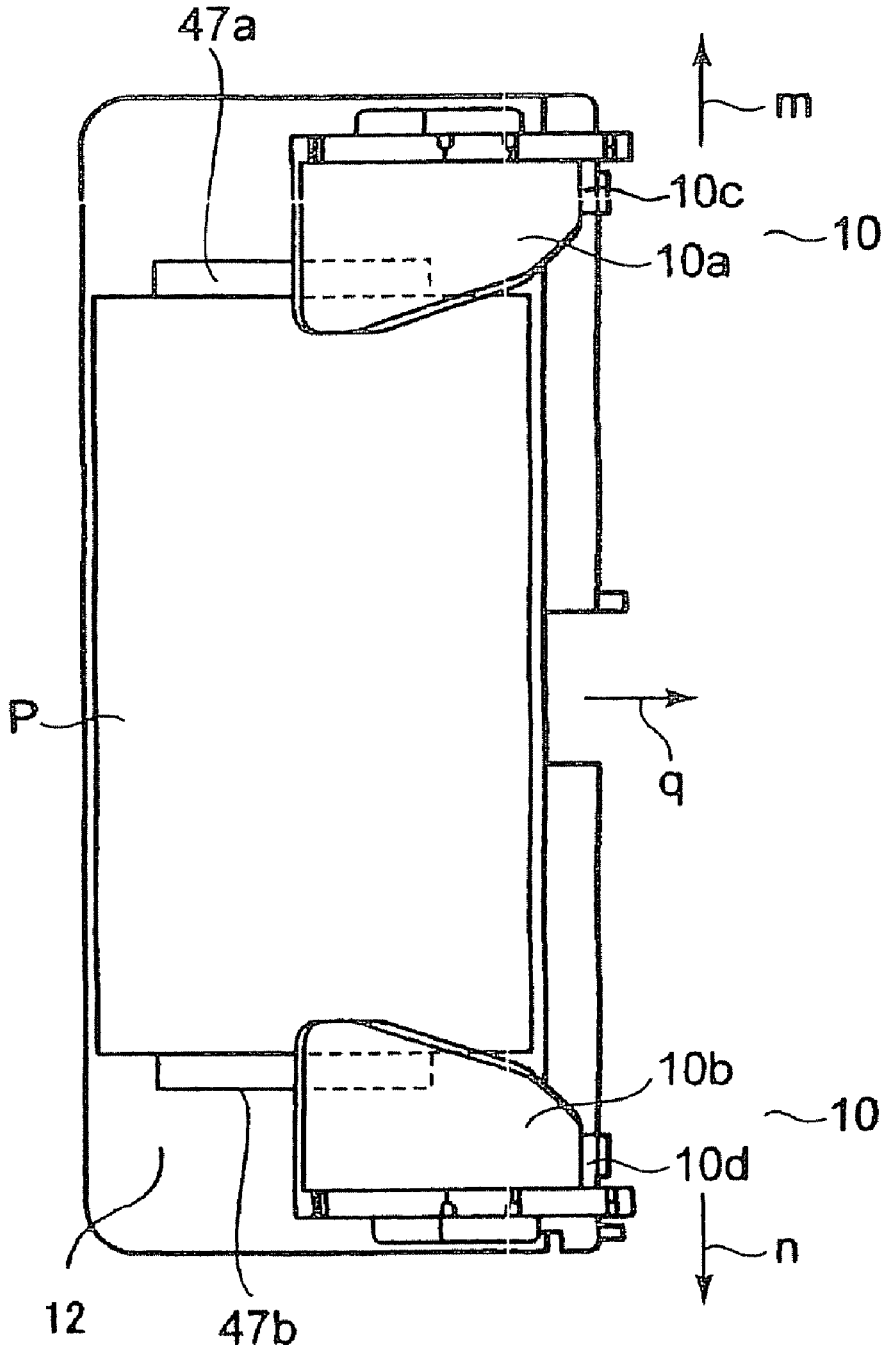
FIG. 6 is a top view showing the standby tray and the processing tray of the sheet processing apparatus of the invention.

FIG. 5 and FIG. 6 schematically show the standby tray 10 and the processing tray 12, and the standby tray 10 includes a pair of tray members 10*a* and 10*b*, receives the sheet P in a state where they slide to the width of the sheet P, and supports both sides of the sheet P. The tray members 10*a* and 10*b* are provided with standby stoppers 10*c* and 10*d* to regulate the rear end of the sheet P.

The standby tray 10 is slide-moved in directions of arrows m and n by a motor (not shown). Before arrival at the processing tray 12 from the standby tray 10, when the sheet P on the standby tray 10 is dropped and supplied to the processing tray 12, there is a case where the sheet P is disturbed in the lateral direction orthogonal to the transport direction.

Figure 7:
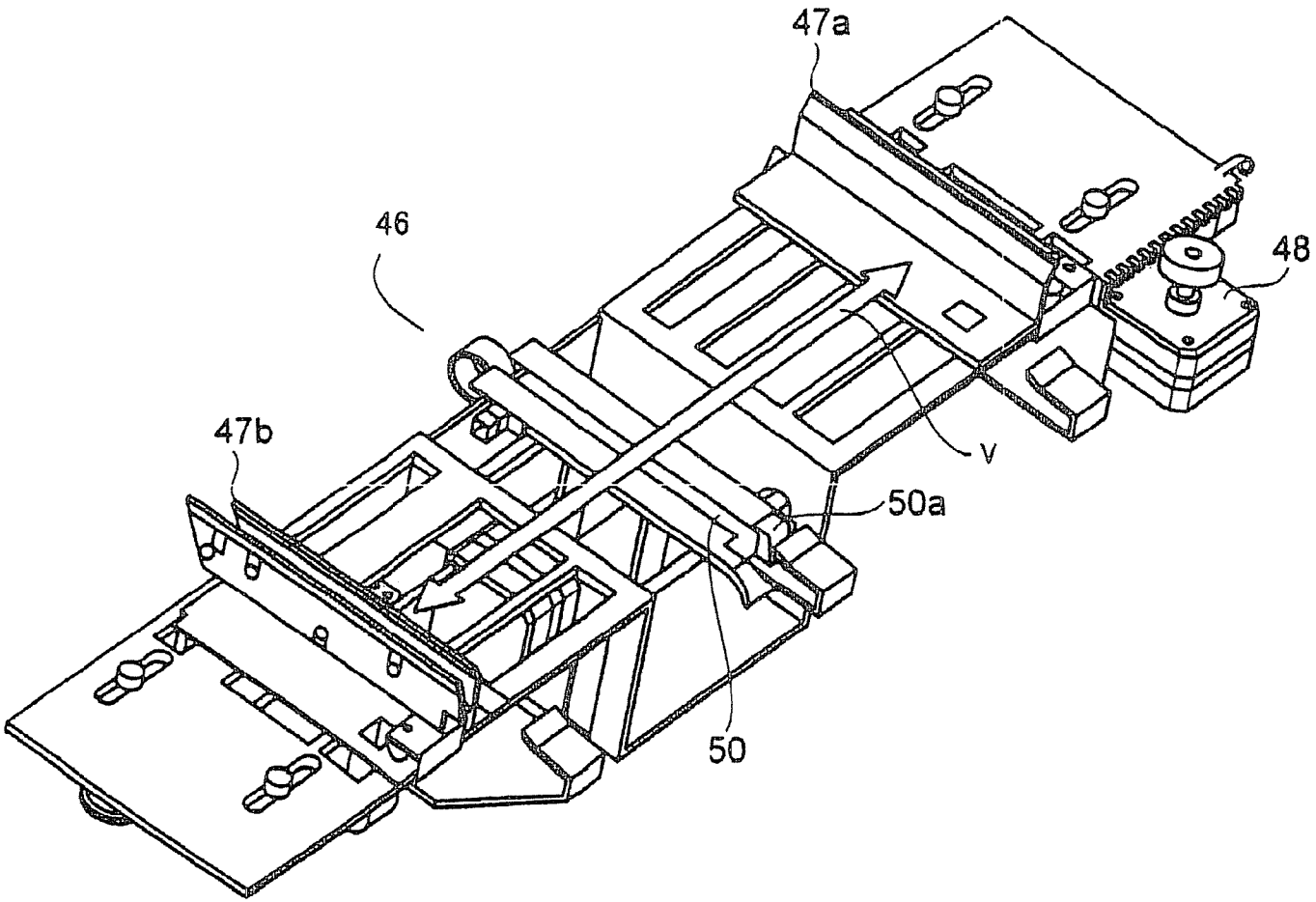
FIG. 7 is a schematic perspective view showing a lateral alignment plate of the sheet processing apparatus of the invention.

Thus, as shown in FIG. 7, a lateral alignment device 46 to prevent the disturbance of the sheet P is provided. The lateral alignment device 46 includes a pair of lateral alignment plates 47*a* and 47*b*, the lateral alignment plates 47*a* and 47*b* can slide in a v direction so as to coincide with the width of the sheet P, and an alignment position can be changed by a motor 48.

By movement-controlling the lateral alignment plates 47*a* and 47*b*, the lateral alignment device 46 is used when the sheets are sorted and discharged.

A driving unit, such as the motors 48, 54, 56 and 58, to drive the various mechanisms is drive-controlled by a control circuit (not shown).

Next, the operation of the post-processing by the sheet post-processing apparatus 2 will be described along the flow of the sheet. Although the sheet subjected to the post-processing is discharged to one of the paper discharge trays 16 and 18, the following description will be made while a case where the sheet is discharged to the paper discharge tray 16 is used as a typical example.

The sheet P transported from the entrance roller 22 through the paper path ceiling 23 is fed onto the standby tray 10 by the paper feed roller 24. Next, the sheet P is dropped onto the standby tray 10.

At the time of dropping of the sheet P, the upper roller 28*a* for longitudinal alignment is retracted upward, and the receiving part 41 of the paddle 40 receives the rear end of the sheet P. Both sides of the sheet P are dropped while they come in contact with the lateral alignment plates 47*a* and 47*b*, and the alignment in the lateral direction is performed.

Next, the paddle 40 is rotated in the arrow y direction as shown in FIG. 3, the rear end of the sheet P is dropped from the receiving part 41, and the sheet is flicked onto the processing tray 12 by the flicking part 42. Further, the paddle 40 sends the sheet P by the sending part 43 in the arrow q direction, the rear end of the sheet P comes in contact with the stopper 45 and the alignment of the sheet P in the longitudinal direction is completed.

In this manner, the sheet P on which an image has been formed is sequentially guided from the paper feed roller 24 to the processing tray 12 while the alignment in the lateral direction and the longitudinal direction is performed.

In the case where the staple processing is performed, when the number of the sheets P placed on the processing tray 12 reaches a specified number, the stapler 14 staples the sheets P on the processing tray 12 at a desired position and forms a sheet bundle. Thereafter, as shown in FIG. 3, the sheet bundle is nipped between the upper roller 28*a* rotating in the arrow r direction and the lower roller 28*b* rotating in the arrow s direction, and is transported in the direction toward the paper discharge tray 16.

When passing through the rollers 28*a* and 28*b*, the rear end of the sheet bundle is caught by the feed hook 50*a* of the transport belt 50 rotated in the arrow t direction, is transported toward the paper discharge tray 16, and then is discharged onto the paper discharge tray 16 by the discharge roller 30.

In the case where the sort processing is performed as the post-processing, the positions of the sheets P in the lateral direction are shifted one by one by the lateral alignment plates 47*a* and 47*b*, and the sheets are discharged onto the paper discharge tray 16.

Although the whole operation of the sheet post-processing apparatus 2 has been described, next, an electricity removing device as a characteristic portion of the invention will be described.

In the case where the sheet transported from the image forming apparatus 1 is subjected to the post-processing, the sheet is often charged with static electricity. When the charged sheet is placed on the standby tray 10, the sheet becomes hard to peel off from the standby tray 10 and is not well dropped onto the processing tray 12, and there is a fear that a jam occurs due to the defective drop. Besides, also in the case where the sheet on the standby tray 10 is discharged to the paper discharge tray 16 as it is, the defective discharge is liable to be caused.

Further, when the sheets placed on the processing tray 12 are charged with electricity, the vertical alignment and lateral alignment of the sheets is not performed correctly, and at the time of stapling, there is a case where the stapling is performed while the sheets are disturbed.

Figure 8:
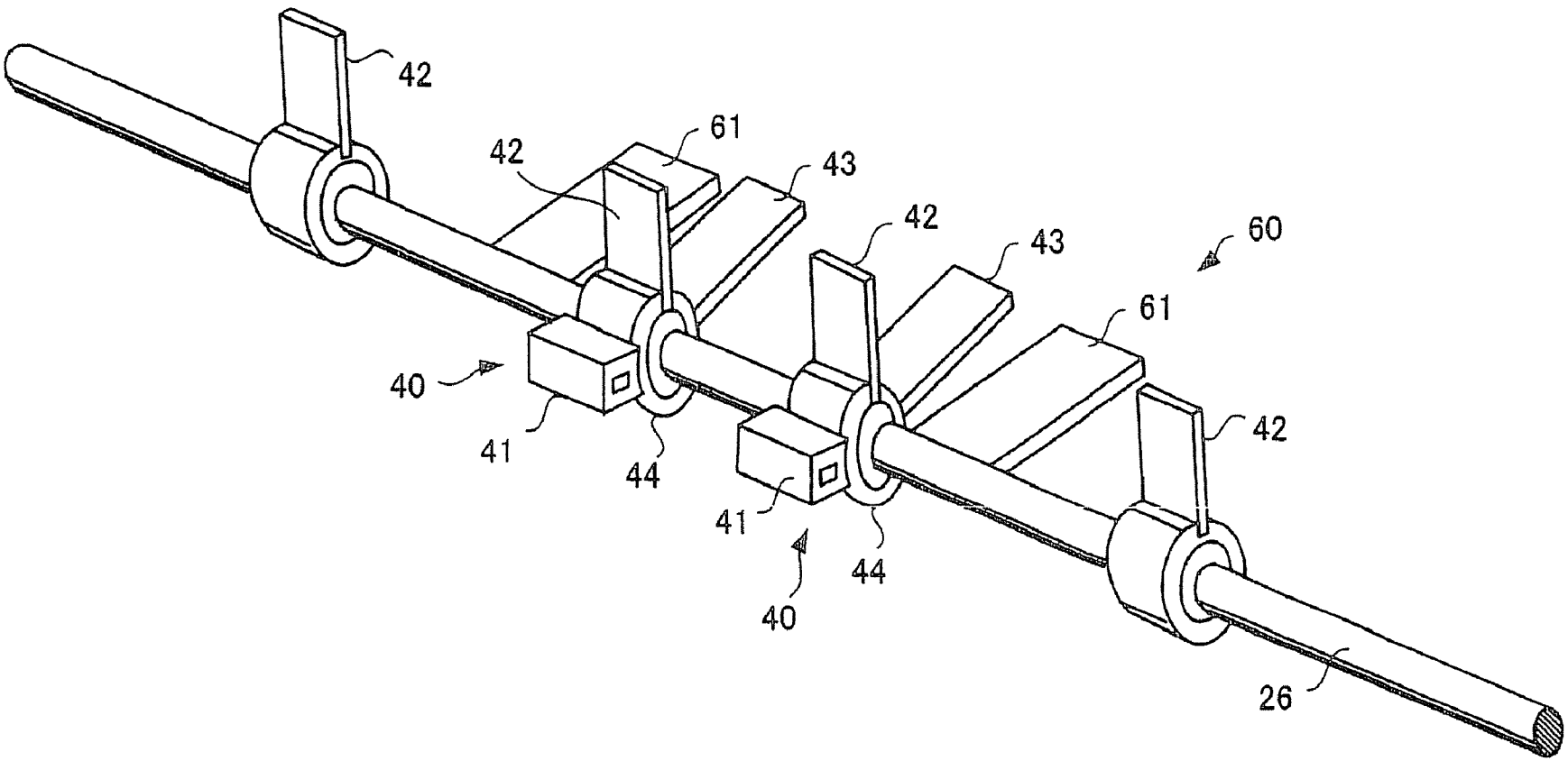
FIG. 8 is a perspective view showing an electricity removing device of the sheet processing apparatus of the invention.

In the invention, in order to prevent the electrostatic charging of the sheet as stated above, an electricity removing device is provided. FIG. 8 is a perspective view showing a structure of an electricity removing device 60.

The electricity removing device 60 includes at least one electricity removing brush 61 attached integrally to the rotation shaft 26 of the paddle 40, and the electricity removing brush 61 is rotated together with the paddle 40. In the example of FIG. 8, two electricity removing brushes 61 are provided to be adjacent to the paddles 40.

Incidentally, the paddle 40 includes the main body part 44 attached to the rotation shaft 26, and the main body part 44 is radially provided with the receiving part 41, the flicking part 42 and the sending part 43. When viewed from the receiving part 41 in the direction toward the flicking part 42, an angle between the receiving part 41 and the sending part 43 is an obtuse angle.

When viewed from a side, the electricity removing brush 61 forms an almost symmetrical angle with respect to the receiving part 41 of the paddle 40. The electricity removing brush 61 is attached to the rotation shaft 26 so as to be parallel to the sending part 43 of the paddle 40. The length of the electricity removing brush 61 is longer than the length of the sending part 43.

The electricity removing brush 61 is made of a conductive material having elasticity, for example, stainless, and is electrically connected to the rotation shaft 26 so as to discharge static electricity to the ground through the rotation shaft 26. Although the electricity removing brush 61 has a thin plate structure in the example shown in the drawing, it may have a beard-like structure.

FIGS. 9A and 9B and FIGS. 10A and 10B are views for explaining the operation of the electricity removing device 60.

Figure 9A:
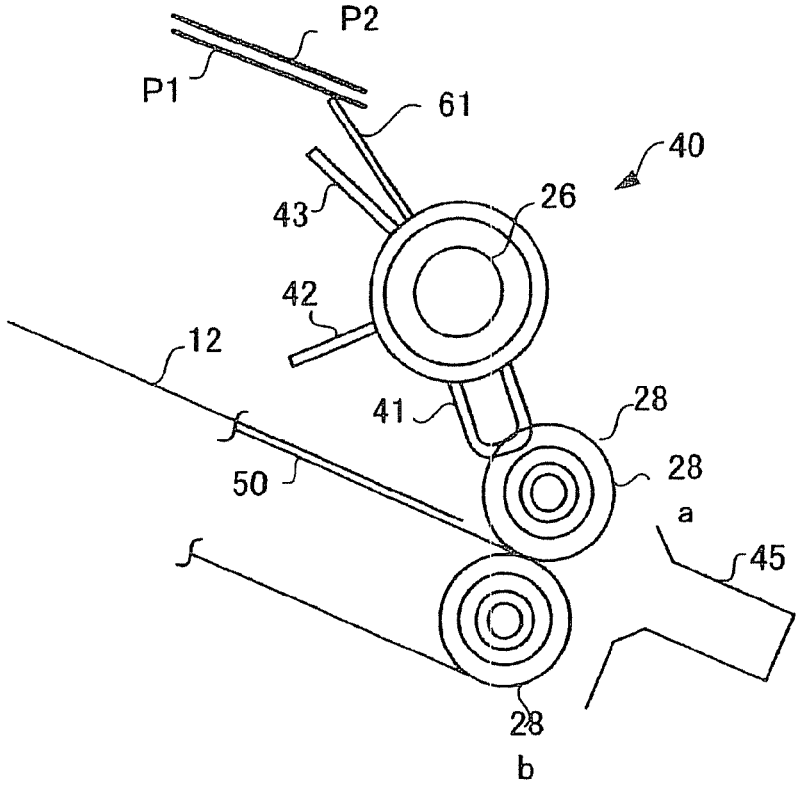
FIG. 9A and FIG. 9B are explanatory views for explaining the operation of the electricity removing device of FIG. 8.

FIG. 9A shows an example in which two sheets at a time are supplied from the standby tray 10 to the processing tray 12. When sheets P1 and P2 are placed on the standby tray 10, the paddle 40 and the electricity removing brush 61 are in a state of FIG. 9A.

In this state, the electricity removing brush 61 is in contact with the first sheet P1, the static electricity charged to the sheet P1 is discharged to the rotation shaft 26 through the electricity removing brush 61 and the electricity is removed.

Figure 9B:
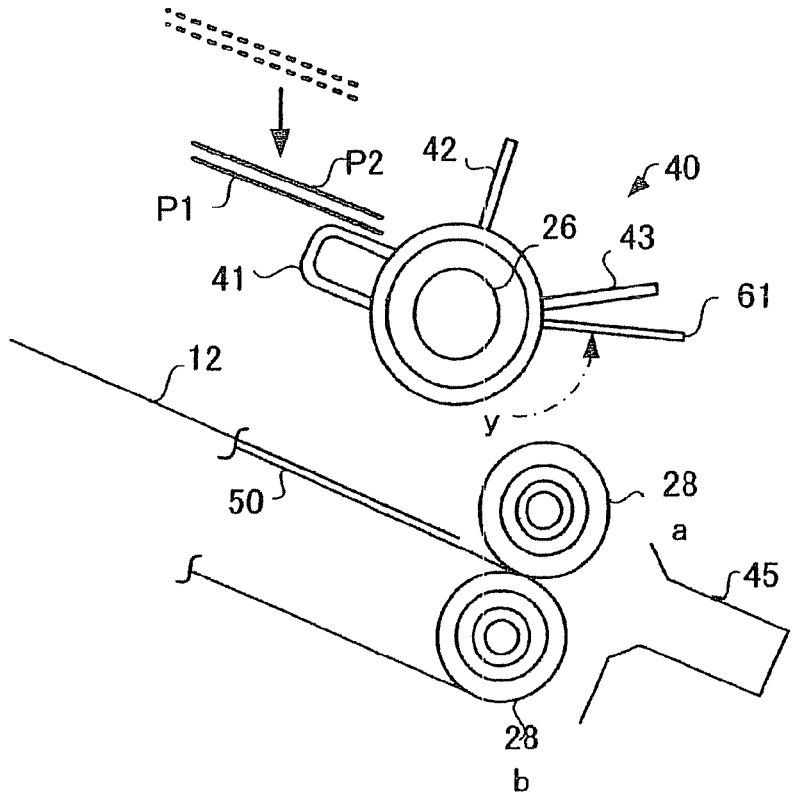

FIG. 9B shows a state in which the sheets P1 and P2 are received by the receiving part 41 of the paddle 40 after the rotation shaft 26 is rotated, the standby tray 10 is opened, and the sheets P1 and P2 are dropped. The paddle 40 is further rotated from this state, and the sheets P1 and P2 are dropped onto the processing tray 12 by the flicking part 42.

Figure 10A:
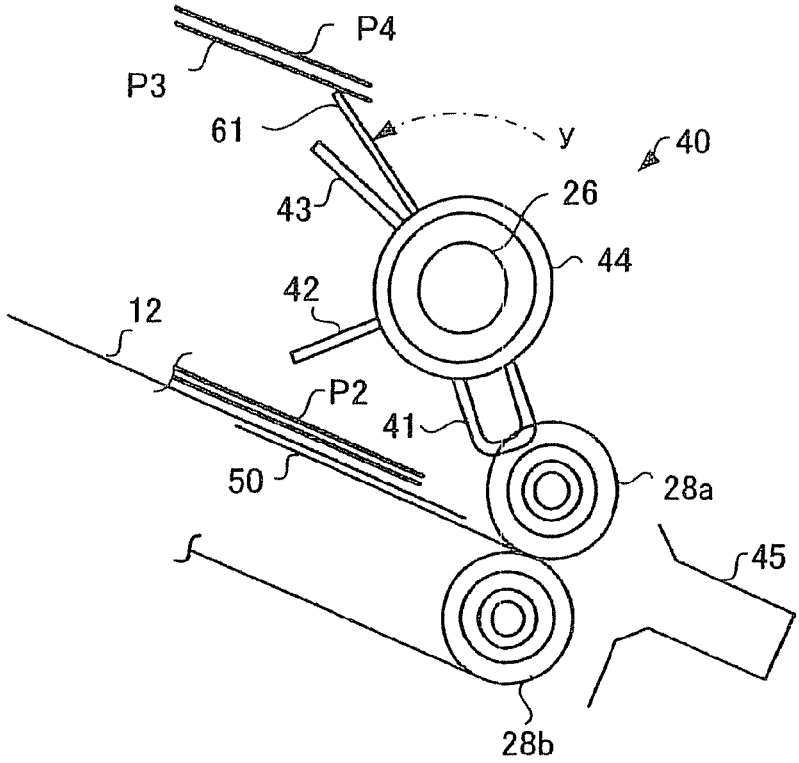
FIG. 10A and FIG. 10B are explanatory views for explaining the operation of the electricity removing device of FIG. 8.

When the rotation shaft 26 makes one rotation, as shown in FIG. 10A, the electricity removing brush 61 is located at the same position as that of FIG. 9A, and waits until next sheets P3 and P4 are placed on the standby tray 10. By this, the electricity removing brush comes in contact with the third sheet P3. Accordingly, the electricity of the sheet P3 is removed.

Figure 10B:
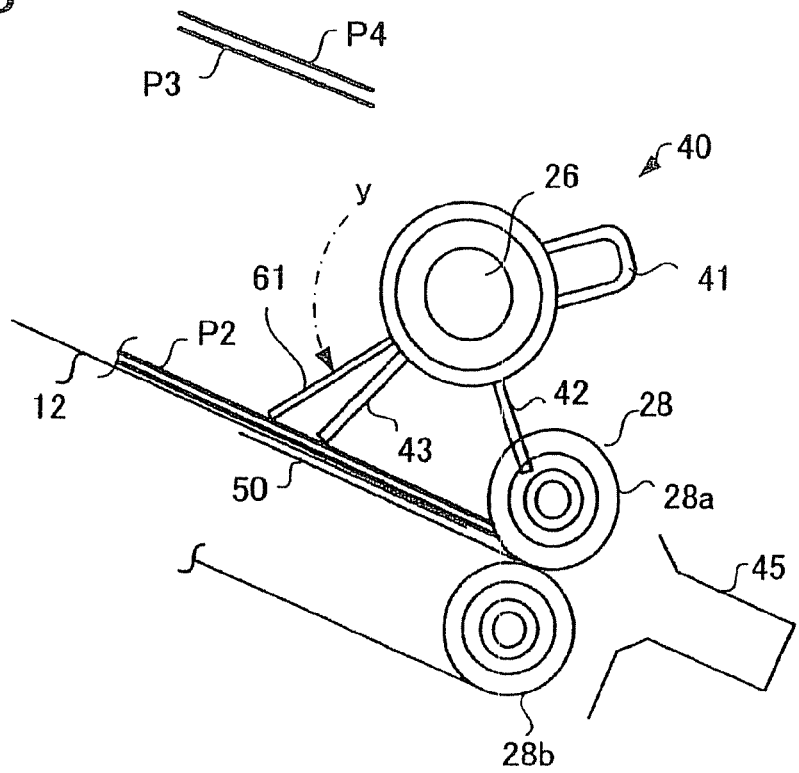

FIG. 10B shows a state where the rotation shaft 26 is further rotated. At this time, the previously dropped sheets P1 and P2 are placed on the processing tray 12, the sheets P1 P2 are sent to the stapler 14 side by the sending part 43, and the electricity removing brush 61 comes in contact with the second sheet P2. By this, the electricity of the second sheet P2 is removed.

After the first and the second sheets P1 and P2 are sent to the stapler 14 side, the standby tray 10 is opened, and the next sheets P3 and P4 are received by the receiving part 41 of the paddle 40.

The sheets are dropped onto the processing tray 12 by the rotation of the paddle 40, and are further sent in the direction toward the stapler 14 by the sending part 43. The electricity of the fourth sheet P4 is removed by the electricity removing brush 61 in a state where it is placed on the processing tray 12.

In this way, the electricity of the sheet placed on the standby tray 10 is removed by the electricity removing brush 61 from the lower side, and the electricity of the sheet placed on the processing tray 12 is removed by the electricity removing brush 61 from the upper side.

Incidentally, in FIG. 9A, when the upper sheet P2 and the lower sheet P1 are in contact with each other, the static electricity of the sheet P2 is also removed at this stage, however, the electricity removing brush 61 makes one rotation so that it comes in contact with the upper side of the sheet P2, and therefore, the electricity removal is certainly performed.

In the case where the staple or sort processing is not performed, the electricity removing brush 61 is in the state of FIG. 9A. Thus, the sheet is sequentially sent to the standby tray 10 one by one, and each time, the electricity removal is performed by the electricity removing brush 61, and the sheet is discharged to the paper discharge tray 16 by the roller 32. Accordingly, since the electricity removal is certainly performed also in the case where the post-processing is not performed, defective discharge can be reduced.

Besides, in FIG. 9A, although the description has been given to the case where two sheets at a time are dropped from the standby tray 10 to the processing tray 12, the electricity removal effect exists also in the case where the sheet is dropped one by one, or two or more sheets at a time are dropped.

As stated above, according to the invention, the static electricity charged to the sheet can be removed. Especially, in a finisher in which the post-processing is performed at high speed, there is a tendency that the amount of electrostatic charging is increased, however, the sheet processing apparatus in which the post-processing is efficiently performed can be provided by removing the static electricity.

Incidentally, no limitation is made to the above description, and various modifications can be made within the scope not departing from the claims.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alternations should therefore be seen as within the scope the present invention.

What is claimed is:

1. A sheet post-processing apparatus comprising:

a sheet transport path to carry a sheet discharged from an image forming apparatus and to guide it to a standby tray;

a processing tray which is provided below the standby tray and on which the sheet supplied from the standby tray is received and can be placed;

a post-processing mechanism to perform a post-processing on the sheet placed on the processing tray;

a sheet discharge unit to discharge the sheet placed on the standby tray or the sheet subjected to the post-processing by the post-processing mechanism;

a paddle which is attached to a rotation shaft disposed in a direction orthogonal to a transport direction of the sheet and flicks the sheet supplied from the standby tray to the processing tray, to align the sheets in a longitudinal direction; and an electricity removing brush which is attached integrally to the rotation shaft and removes electricity of the sheet while being rotated together with the paddle, the electricity removing brush is rotated to a position where comes in contact with the lowermost surface of the sheet on the standby tray when the sheet is placed on the standby tray, and comes in contact with the uppermost surface of the sheet aligned by the paddle on the processing tray and is rotated when the sheet dropped from the standby tray is placed on the processing tray.

2. The sheet post-processing apparatus according to claim 1, wherein the paddle includes a receiving part to receive an end of the sheet supplied from the standby tray, a flicking part to flick the sheet separated from the receiving part to the processing tray, and a sending part to send the sheet of the processing tray to the post-processing mechanism which are radially attached around the rotation shaft, and the electricity removing brush is attached to the rotation shaft to be adjacent to the paddle and to be parallel to the sending part.

3. The sheet processing apparatus according to claim 1, wherein a plurality of the paddles and a plurality of the electricity removing brushes are provided to the rotation shaft.

4. The sheet processing apparatus according to claim 1, wherein the paddle is disposed at a center of the rotation shaft, and the electricity removing brushes are disposed at both sides of the paddle of the rotation shaft.

5. The sheet post-processing apparatus according to claim 1, wherein the electricity removing brush is made of a conductive member having elasticity.

6. The sheet post-processing apparatus according to claim 1, wherein the electricity removing brush is made of a conductive thin plate member.

7. A sheet post-processing method comprising:

guiding to a standby tray a sheet discharged from an image forming apparatus;

placing the sheets supplied from the standby tray to a processing tray which is provided below the standby tray;

performing a post-processing on the sheet placed on the processing tray by a post-processing mechanism;

discharging the sheet placed on the standby tray or the sheet subjected to the post-processing by the post-processing mechanism;

attaching a paddle to a rotation shaft disposed in a direction orthogonal to a transport direction of the sheet, and flicking the sheet supplied from the standby tray to the processing tray, to align the sheets in a longitudinal direction;

attaching an electricity removing brush integrally to the rotation shaft and removes electricity of the sheet by the electricity removing brush while being rotated together with the paddle;

when the sheet is placed on the standby tray, the electricity removing brush is rotated to a position where it comes in contact with the lowermost surface of the sheet on the standby tray; and when the sheet dropped from the standby tray is placed on the processing tray, the electricity removing brush comes in contact with the uppermost surface of the sheet aligned by the paddle on the processing tray and is rotated.

8. A sheet post-processing method according to claim 7, wherein the paddle includes a receiving part to receive an end of the sheet supplied from the standby tray, a flicking part to flick the sheet separated from the receiving part to the processing tray, and a sending part to send the sheet of the processing tray to the post-processing mechanism which are radially attached around the rotation shaft, and the electricity removing brush is attached to the rotation shaft to be adjacent to the paddle and to be parallel to the sending part.

9. The sheet post-processing method according to claim 7, wherein a plurality of the paddles and a plurality of the electricity removing brushes are provided to the rotation shaft.

10. The sheet post-processing method according to claim 7, wherein the paddle is disposed at a center of the rotation shaft, and the electricity removing brushes are disposed at both sides of the paddle of the rotation shaft.

11. The sheet post-processing method according to claim 7, wherein the electricity removing brush is made of a conductive member having elasticity.

12. The sheet post-processing method according to claim 7, wherein the electricity removing brush is made of a conductive thin plate member.

* * * * *